US006652238B2

(12) United States Patent
Kajiwara et al.

(10) Patent No.: US 6,652,238 B2
(45) Date of Patent: Nov. 25, 2003

(54) HIGH-PRESSURE DOME TYPE COMPRESSOR

(75) Inventors: Mikio Kajiwara, Sakai (JP); Ryohei Deguchi, Sakai (JP); Nobuhiro Nojima, Sakai (JP); Keiji Komori, Sakai (JP); Kazuo Ida, Kusatsu (JP); Masatoshi Hirano, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/959,991

(22) PCT Filed: Mar. 26, 2001

(86) PCT No.: PCT/JP01/02390

§ 371 (c)(1),
(2), (4) Date: Nov. 14, 2001

(87) PCT Pub. No.: WO01/75307

PCT Pub. Date: Oct. 11, 2001

(65) Prior Publication Data

US 2002/0159890 A1 Oct. 31, 2002

(30) Foreign Application Priority Data

Mar. 31, 2000 (JP) ..... 2000-97399

(51) Int. Cl.[7] ..... F04B 49/06
(52) U.S. Cl. ..... 417/44.1; 417/44.11; 417/902
(58) Field of Search ..... 417/44.1, 45, 902; 318/473; 252/68; 62/469, 498

(56) References Cited

U.S. PATENT DOCUMENTS 4,382,370 A * 5/1983 Suefuji et al. ..... 62/498
4,626,753 A * 12/1986 Letterman ..... 318/473
5,006,045 A * 4/1991 Shimoda et al. ..... 417/45
5,445,753 A * 8/1995 Fukuda et al. ..... 252/68
5,806,336 A * 9/1998 Sunaga et al. ..... 62/469
5,975,854 A * 11/1999 Culp, III et al. ..... 417/44.1
6,102,677 A * 8/2000 Iida et al. ..... 417/902
6,354,805 B1 * 3/2002 Moller ..... 318/473

FOREIGN PATENT DOCUMENTS

JP 5-211796 A 8/1993
JP 7-337072 A 12/1995
JP 10-75542 A 3/1998

* cited by examiner

*Primary Examiner*—Michael Koczo
(74) *Attorney, Agent, or Firm*—Birch, Stewart, Kolasch & Birch, LLP

(57) ABSTRACT

A high-pressure, dome-type compressor includes a DC motor 5 having a rotor 5*a* that uses a rare earth/iron/boron permanent magnet having an intrinsic coercive force of 1.7 $MA.m^{-1}$ or greater in a rotor thereof and has a rated output or 1.9 kW or higher. The motor, which drives a compression element 3 in a casing 2, is disposed in a high pressure, high temperature area 6, which is filled with gas discharged from the compression element. An inverter 10 controls current supplied to the motor such that the motor temperature becomes equal to or less than a predetermined temperature and an opposing magnetic field generated in a stator has a predetermined strength or less. Since the magnet does not reach a high temperature and is not exposed to a strong opposing magnetic field, it is hardly demagnetized. As a result, performance of the motor and of the compressor is stable.

7 Claims, 5 Drawing Sheets

HIGH-PRESSURE DOME TYPE COMPRESSOR

This application is the national phase under 35 U.S.C. §371 of PCT International Application No. PCT/JP01/02390 which has an International filing date of Mar. 26, 2001, which designated the United States of America.

TECHNICAL FIELD

The present invention relates to a high-pressure dome type compressor comprising a motor using a rare earth magnet.

BACKGROUND ART

Conventional compressors for a refrigerant unit include a high-pressure dome type compressor comprising a compression element and a motor for driving the compression element in a casing. The motor of this high-pressure dome type compressor is disposed in a high pressure area filled with gas discharged from the compression element in the casing. The motor is a dc (direct current) motor driven under control of an inverter. A permanent magnet of a rotor of the motor is composed of a ferrite magnet having a great intrinsic coercive force.

However, since the ferrite magnet has a relatively little magnetic force, a large permanent magnet is required in order to increase output of the motor. Therefore, the rotor is upsized and thus the motor is upsized. Consequently, a problem arises that the compressor is upsized since the motor is upsized to increase output of the compressor.

Then, a high-pressure dome type compressor which could be downsized even with high output by using a rare earth magnet having a great magnetic force as a permanent magnet for a rotor of a motor was proposed recently.

In the high-pressure dome type compressor, however, the rare earth magnet is demagnetized due to heat generated by the motor or compression heat from a refrigerant, thereby degrading performance of the motor since the rare earth magnet used for the rotor of the motor is demagnetized with a temperature rise. Also, after a certain limit is exceeded, irreversible demagnetization occurs and the magnetic force is lost and thereby functions of the motor are lost. Furthermore, the rare earth magnet is demagnetized even when an opposing magnetic field is received. Therefore, when a current flowing in the motor increases, the rare earth magnet for the rotor is demagnetized by an opposing magnetic field generated in a stator of the motor, thereby degrading performance of the motor. Thus, a problem arises that a rare earth magnet cannot be used in a large-sized high-pressure dome type compressor with high output. More specifically, a motor having a rare earth magnet cannot be used in a high-pressure dome type compressor which uses R32 as a refrigerant and has a motor with a rated output of 1.9 kW or higher.

DISCLOSURE OF THE INVENTION

Accordingly, an object of the present invention is to provide a small-sized high-pressure dome type compressor with high output which has stable performance without causing irreversible demagnetization in a rare earth magnet even when the rare earth magnet is used for a motor.

Another object of the present invention is to provide a small-sized high-pressure dome type compressor with high output which has stable performance without causing irreversible demagnetization in a rare earth magnet even when used in a refrigerant unit using R32, as a refrigerant, which obtains a high temperature when compressed.

In order to achieve the aforementioned objects, there is provided a high-pressure, dome-type compressor comprising a compression element and a motor for driving the compression element in a casing, "dome-type" being defined as having an end surface of the compressor casing which forms a dome shape. The motor is disposed in a high pressure area filled with a gas discharged from the compression element in the casing and has a rated output of 1.9 kW or higher. In addition, a rotor of the motor includes a rare earth/iron/boron permanent magnet having an intrinsic coercive force of 1.7 $MA.m^{-1}$ or greater, wherein M is mega, A is ampere, and m is meter.

In the above high-pressure dome type compressor, since the rare earth/iron/boron permanent magnet provided to the rotor of the motor has an intrinsic coercive force of 1.7 $MA.m^{-1}$ or greater, the permanent magnet is hardly demagnetized and no irreversible demagnetization occurs even in the high-pressure dome type compressor, which obtains a relatively high temperature. Furthermore, the permanent magnet is hardly demagnetized and no irreversible demagnetization occurs in the motor having a rated output of 1.9 kW or higher and a relatively strong opposing magnetic field generated in a stator of the motor as well. Therefore, the motor using the rare earth/iron/boron permanent magnet has higher output and a smaller size as well as more stable performance than a conventional motor using a ferrite permanent magnet. Thus, the high-pressure dome type compressor provided with the motor has high output and a small size and that performance of the high-pressure dome type compressor becomes stable.

In one embodiment, the high-pressure dome type compressor further comprises:

a temperature sensor for detecting a temperature of the motor; and first control means for, upon receipt of a signal from the temperature sensor, controlling a current to be supplied to the motor such that the temperature of the motor becomes equal to a predetermined temperature or lower.

In the above high-pressure dome type compressor, the sensor detects the temperature of the motor having the rare earth/iron/boron permanent magnet and notifies the temperature to the first control means. This first control means reduces the current to be supplied to the motor and reduces the number of revolutions of the motor when the temperature of the motor is higher than the predetermined temperature. Consequently, heat generated by the motor is reduced and the temperature of the motor lowers. As a result, demagnetization of the rare earth/iron/boron permanent magnet provided to the motor is prevented.

In one embodiment, the high-pressure dome type compressor further comprises:

current detecting means for detecting a current flowing in the motor;

second control means for receiving a signal from the current detecting means and controlling a current to be supplied to the motor such that an opposing magnetic field generated in the motor becomes equal to a predetermined strength or less.

In the above high-pressure dome type compressor, the current detecting means detects a value of the current supplied to the motor having the rare earth/iron/boron permanent magnet and notifies the value to the second control means. This second control means calculates strength of an opposing magnetic field generated in the motor based on the value of the current to be supplied to the motor. When the strength of this opposing magnetic field is greater than the predetermined value, the second control means reduces the current to be supplied to the motor and weakens the strength of the opposing magnetic field in the motor. Therefore, demagnetization of the rare earth/iron/boron permanent magnet provided to the motor is prevented.

In one embodiment, a discharge pipe for discharging the discharged gas from the casing is disposed on a side of the motor opposite from the compression element.

In the above high-pressure dome type compressor, since the compression element is disposed on one side of the motor and the discharge pipe is disposed on the other side, the discharged gas compressed by the compression element passes through the motor disposed in the high pressure area filled with this discharged gas and then discharged from the discharge pipe to the outside of the casing. Therefore, the motor is cooled by the discharged gas and thereby demagnetization of the rare earth/iron/boron permanent magnet provided to the motor is prevented.

In one embodiment, a discharge pipe is communicated with the high pressure area between the compression element and the motor, while the gas discharged from the compression element passes through a path in a crank shaft and is discharged to the high pressure area on a side of the motor opposite from the compression element.

In the above high-pressure dome type compressor, after the discharged gas from the compression element passes through the path in the crank shaft and is discharged to the high pressure area on the side of the motor opposite from the compression element, the discharged gas passes through the motor and is discharged from the discharge pipe to the outside of the casing. Therefore, the motor is cooled by the discharged gas and thereby demagnetization of the rare earth/iron/boron permanent magnet provided to the motor is prevented.

In one embodiment, the permanent magnet for the rotor of the motor is coated with aluminium.

In the above high-pressure dome type compressor, since the permanent magnet for the rotor of the motor is coated with aluminium, the permanent magnet does not become rusty even in the high pressure area of the high-pressure dome type compressor having a relatively high temperature. Since the refrigerant gas does not flow into the permanent magnet, deterioration by the refrigerant is also prevented. Further, when the high-pressure dome type compressor is used for a refrigerant unit using R32 as a refrigerant, the permanent magnet is not attacked by the R32 due to the aluminium coating. Therefore, performance of the motor is maintained and performance of the high-pressure dome type compressor becomes stable.

In one embodiment, a refrigerant unit comprises the high-pressure dome type compressor of the present invention and uses R32 as a refrigerant.

In the above refrigerant unit, even though R32, which is compressed in the high-pressure dome type compressor and obtains a high temperature, is used as the refrigerant, the rare earth/iron/boron permanent magnet of the motor provided to this high-pressure dome type compressor is hardly demagnetized since this high-pressure dome type compressor is provided. Therefore, the motor has a small size and high output as well as stable performance. As a result, the high-pressure dome type compressor provided with the motor has a small size and high output as well as stable performance. Thus, performance of the refrigerant unit provided with the high-pressure dome type compressor becomes stable.

BEST MODE FOR CARRYING OUT THE INVENTION

Figure 1:
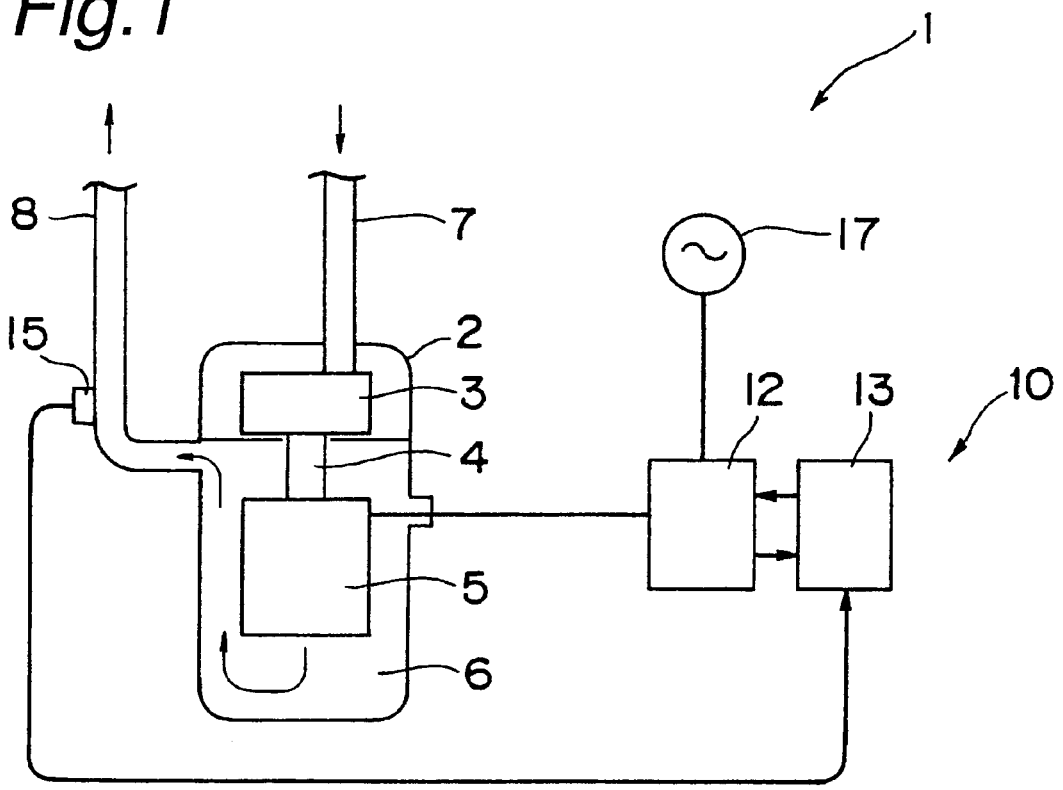
FIG. 1 is a schematic view showing a high-pressure dome type compressor according to an embodiment of the invention.

The present invention will be described below in detail with reference to embodiments shown in the drawings.

FIG. 1 is a schematic view showing a high-pressure dome type compressor according to the present invention. This high-pressure dome type compressor 1 is provided with a compression element 3 and a DC motor 5 driving the compression element 3 via a crank shaft 4 in a casing 2. This motor 5 is disposed in a high pressure area 6 filled with a discharged gas compressed by the compression element 3 in the casing 2.

Figure 5:
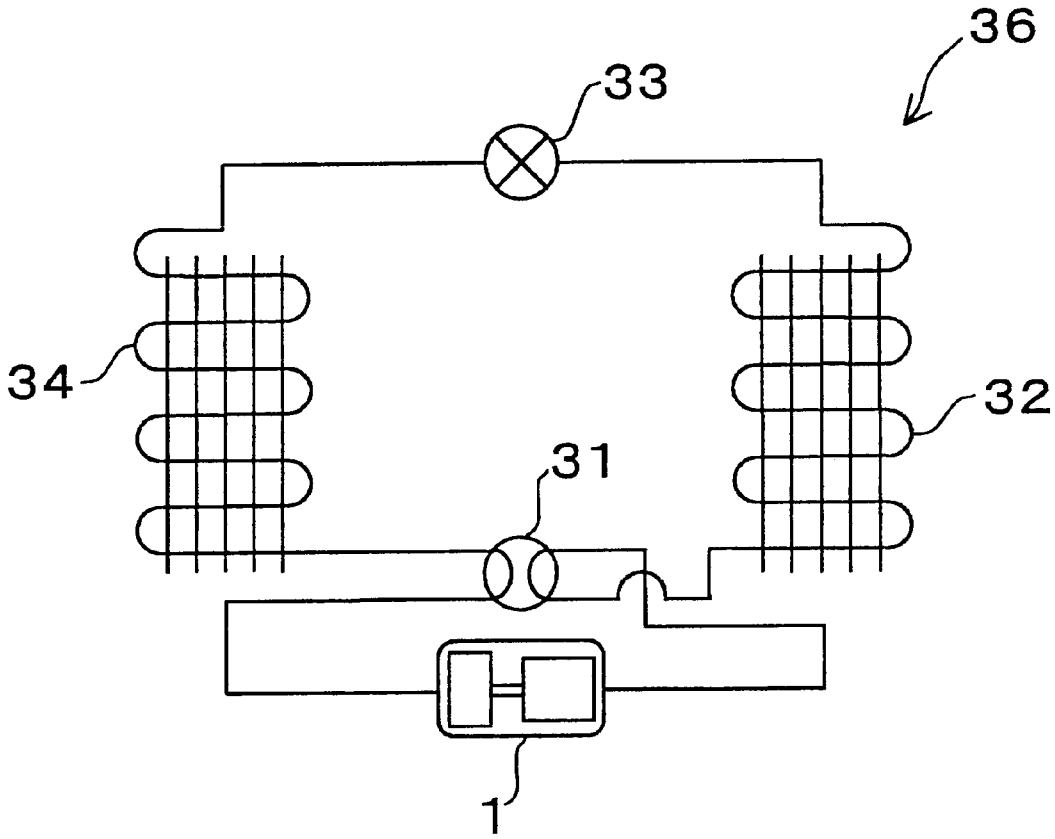
FIG. 5 shows a refrigerant unit comprising the high-pressure dome type compressor shown in FIG. 1.

The high-pressure dome type compressor 1 is also provided with a suction pipe 7 communicated with the compression element 3 and a discharge pipe 8 communicated with the high pressure area. As shown in FIG. 5, this high-pressure dome type compressor 1 is successively connected to a four-way switching valve 31, outdoor heat exchanger 32, expansion mechanism 33 and indoor heat exchanger 34 to constitute a refrigerant unit 36 according to the present invention. This refrigerant unit 36 uses R32 as a refrigerant.

Furthermore, the high-pressure dome type compressor 1 has an inverter 10 as first and second control means for controlling a current to be supplied to the motor 5. This inverter 10 is composed of an inverter unit 12 and a control unit 13. The inverter unit 12 converts input power from an ac power supply 17 to dc power in response to a command from the control unit 13 and then converts to a signal having a predetermined duty factor in a predetermined frequency and outputs the signal. The control unit 13 receives output from a temperature sensor 15 for detecting a temperature of the discharge pipe 8 and controls output current from the inverter unit 12.

Figure 2:
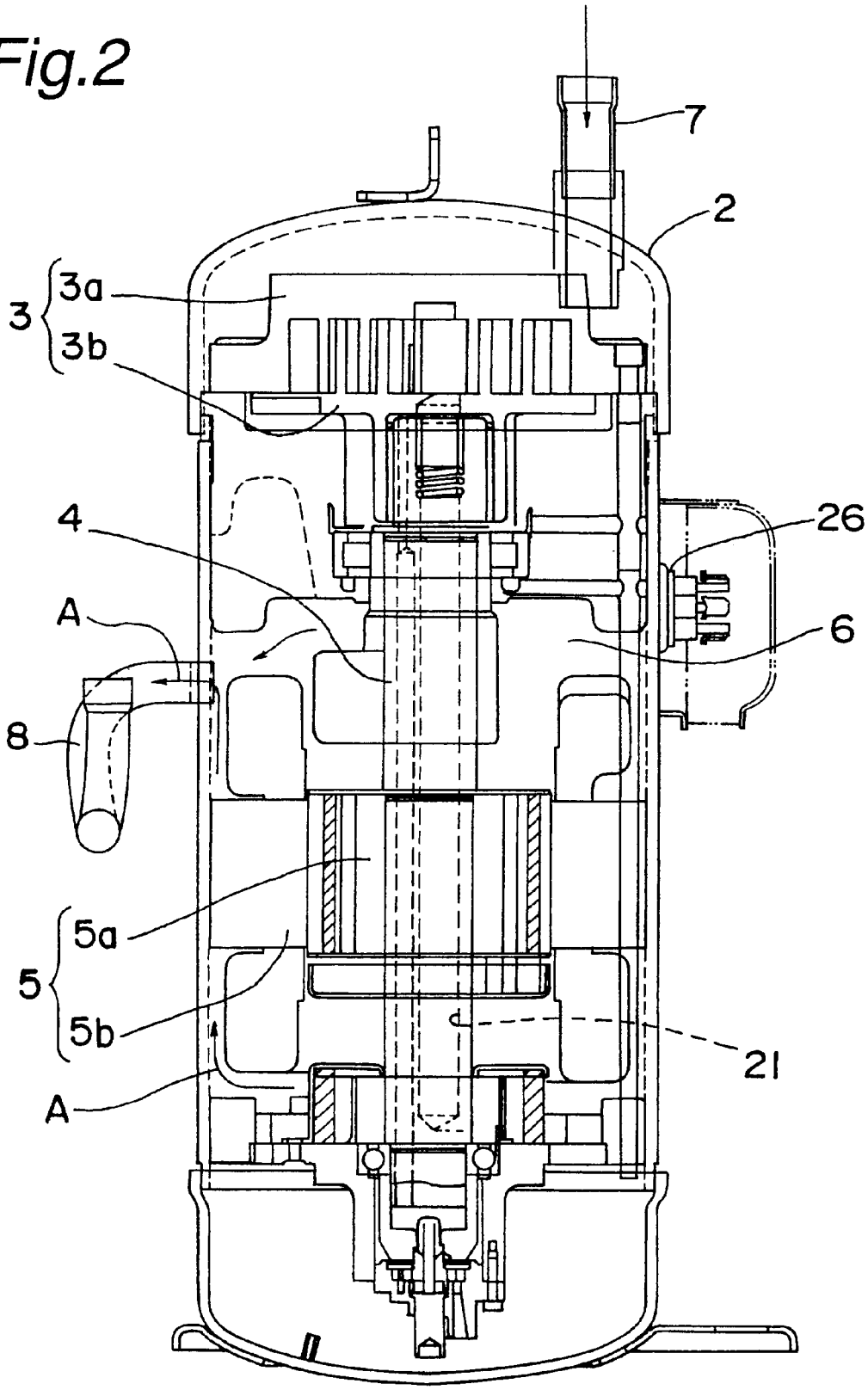
FIG. 2 is a detailed cross sectional view showing the inside of a casing of the high-pressure dome type compressor shown in FIG. 1.

FIG. 2 is a detailed cross sectional view showing the inside of the casing 2 of the high-pressure dome type compressor 1. Portions having the same functions as those shown in FIG. 1 are designated by the same reference numerals. The high-pressure dome type compressor is provided a scroll unit 3 as a compression element and a motor 5 driving the scroll unit 3 via a crank shaft 4 in the casing 2. This motor 5 is disposed in a high pressure area 6 filled with a discharged gas compressed in the scroll unit 3.

The scroll unit 3 is composed of a fixed scroll 3*a* and a turning scroll 3*b*. The turning scroll 3*b* is connected to the crank shaft 4 without being co-axial with the center of the crank shaft 4. A path 21 for guiding a discharged gas compressed in the scroll unit 3 from the scroll unit 3 to below the motor 5 is provided in this crank shaft 4.

Figure 3:
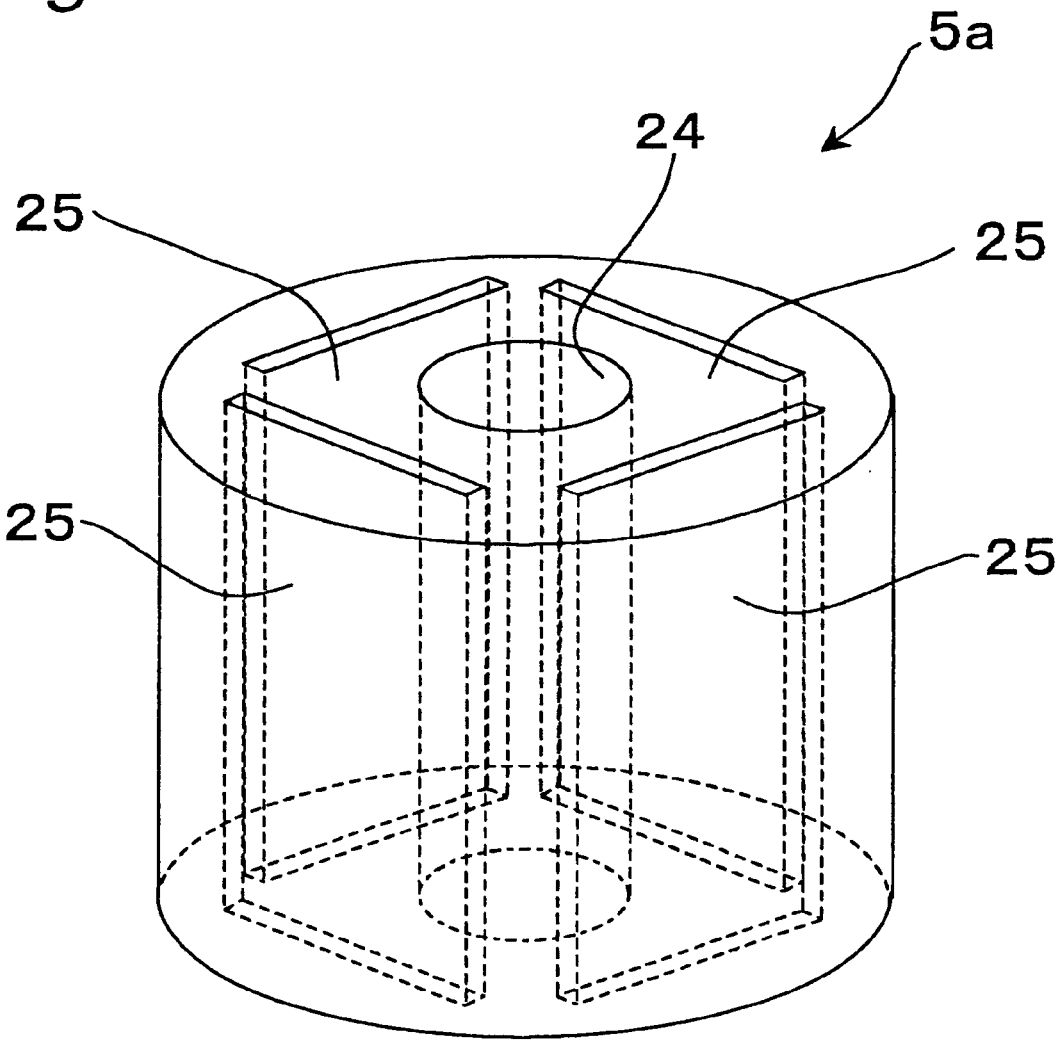
FIG. 3 is a perspective view showing a rotor of a motor provided to the high-pressure dome type compressor shown in FIG. 2.

The motor 5 is composed of a cylindrical rotor 5*a* fixed to the crank shaft 4 and a stator 5*b* disposed in the vicinity of a peripheral surface of this rotor 5*b*. In the rotor 5*a*, as shown in FIG. 3, four plate-like rare earth/iron/boron permanent magnets 25, 25, 25, 25 are provided at an angle of 90° to each other surrounding a shaft hole 24 to which the crank shaft is inserted. The rare earth/iron/boron permanent magnet 25 has an intrinsic coercive force of 1.7 $MA.m^{-1}$ or greater. The motor having the rare earth/iron/boron permanent magnet 25 has a smaller size and higher output than a conventional motor having a ferrite magnet and has a rated output of 1.9 kW or higher. It is noted that the surface of the rare earth/iron/boron permanent magnet 25 is coated with aluminum.

As shown in FIG. 2, a suction pipe 7 which is communicated with the scroll unit 3 and guides a refrigerant from a evaporator is provided on the top of casing 2. A discharge pipe 8 which is communicated with the high pressure area 6 and discharges the discharged gas to a condenser is provided on the left side of the casing 2. Furthermore, a terminal 26 for supplying drive current from the inverter 10 in FIG. 1 to the motor 5 is disposed on the right side of the casing 2.

In the high-pressure dome type compressor according to the above constitution, the inverter 10 shown in FIG. 1 supplies predetermined current to the motor 5 and the motor 5 rotates the crank shaft 4. Then, the turning scroll 3*b* connected to the crank shaft 4 is rotated without being co-axial with the crank shaft 4 and the scroll unit 3 performs compression operation. That is, a refrigerant gas which composed of R32 and guided from the evaporator to the scroll unit 3 through the suction pipe 7 is compressed in the scroll unit 3 and discharged through the path 21 in the crank shaft 4 to below the motor 5. As shown in FIG. 2, this discharged gas discharged to below the motor 5 is discharged from a discharge pipe 8 disposed on the left side of the casing 2 between the motor 5 and the scroll unit 3 to the condenser. At this time, as shown by arrow A, the discharged gas passes between the motor 5 and casing 2 and between rotor 5*a* and stator 5*b* of the motor 5. Consequently, the motor 5 is cooled by the discharged gas. Therefore, since the rare earth/iron/boron permanent magnets 25, 25, 25, 25 provided to the rotor 5*a* of the motor 5 do not obtain an abnormally high temperature, the magnets are hardly demagnetized. As a result, performance of the motor 5 is maintained and performance of the high-pressure dome type compressor 1 becomes stable.

When the high-pressure dome type compressor 1 is continuously operated for a long time, the motor 5 may be heated and the temperature may become equal to a predetermined temperature or higher. In this case, the temperature sensor 15 provided to the discharge pipe 8 shown in FIG. 1 detects the temperature rise of the motor 5 by detecting the temperature rise of the discharged gas and sends a signal to the control unit 13 of the inverter 10. The control unit 13 receiving the signal from the temperature sensor 15 performs drooping control to reduce output current of the inverter unit 12, thereby reducing the number of revolutions of the motor 5. Then, when heat generated by the motor 5 is reduced and the temperature detected by the temperature sensor 15 lowers to the predetermined temperature, the control unit 13 recovers the output of the inverter unit 12 to a normal value. Thus, heat generated by the motor 5 is reduced by controlling a current to be supplied to the motor 5 such that a temperature of the motor 5 does not exceed a predetermined temperature obtained from a demagnetizing characteristic with respect to a temperature of the rare earth/iron/boron permanent magnet 25. As a result, since the rare earth/iron/boron permanent magnet 25 is hardly demagnetized and is not in a temperature range causing irreversible demagnetization, performance of the motor 5 becomes stable. Thus, performance of the high-pressure dome type compressor 1 provided with this motor 5 becomes stable.

Also, since this high-pressure dome type compressor 1 is provided in a refrigerant unit 36 using R32 as a refrigerant, a discharged gas composed of R32 which is compressed in the scroll unit 3 and filled in the high pressure area 6 has a higher temperature than in a case where, for example, CFC (chlorofluorocarbon) or the like is used as a conventional refrigerant. However, since the temperature of the motor 5 is controlled by the inverter unit 10 not to be higher than a predetermined temperature in this high-pressure dome type compressor 1, the rare earth/iron/boron permanent magnet 25 provided to this motor 5 is hardly demagnetized. Therefore, performance of the motor 5 becomes stable, thereby resulting in stable performance of the high-pressure dome type compressor 1.

In addition, the high pressure area 6 filled with the discharged gas composed of R32 as a refrigerant has the high temperature and further has a small amount of water content. However, since the surface of the rare earth/iron/boron permanent magnet 25 is coated with aluminium, the magnet is not attacked by the R32 and hardly becomes rusty. Therefore, performance of the motor 5 becomes stable.

Furthermore, due to control by the control unit 13 of the inverter 10, an opposing magnetic field equals to or greater than a predetermined strength obtained from a demagnetizing characteristic with respect to an opposing magnetic field in the rare earth/iron/boron permanent magnet 25 is not generated in the stator 5*b* of the motor 5. That is, the control unit 13 receives a value of current to be supplied from the inverter unit 12 to the motor 5 and calculates strength of the opposing magnetic field to be generated by this current in the stator 5*b* of the motor 5. If the current to be supplied to the motor 5 exceeds the predetermined quantity and the opposing magnetic field of the stator 5*b* exceeds the predetermined strength, the control unit 13 controls output current from the inverter unit 12 and weakens the opposing magnetic field in the stator 5*b* of the motor to the predetermined strength. Thus, since the opposing magnetic field in the stator 5*b* of the motor does not exceed the predetermined strength by controlling the inverter 10 and thereby demagnetization of the permanent magnet of the motor 5 is prevented, performance of this motor 5 becomes stable and no irreversible demagnetization occurs. Thus, performance of the high-pressure dome type compressor 1 provided with this motor 5 becomes stable.

Thus, since the high-pressure dome type compressor 1 can obtain stable performance even when a refrigerant composed of R32 is compressed, a refrigerant unit 36 which comprises this high-pressure dome type compressor 1 and uses the refrigerant composed of R32 can obtain stable freezing performance.

Figure 4:
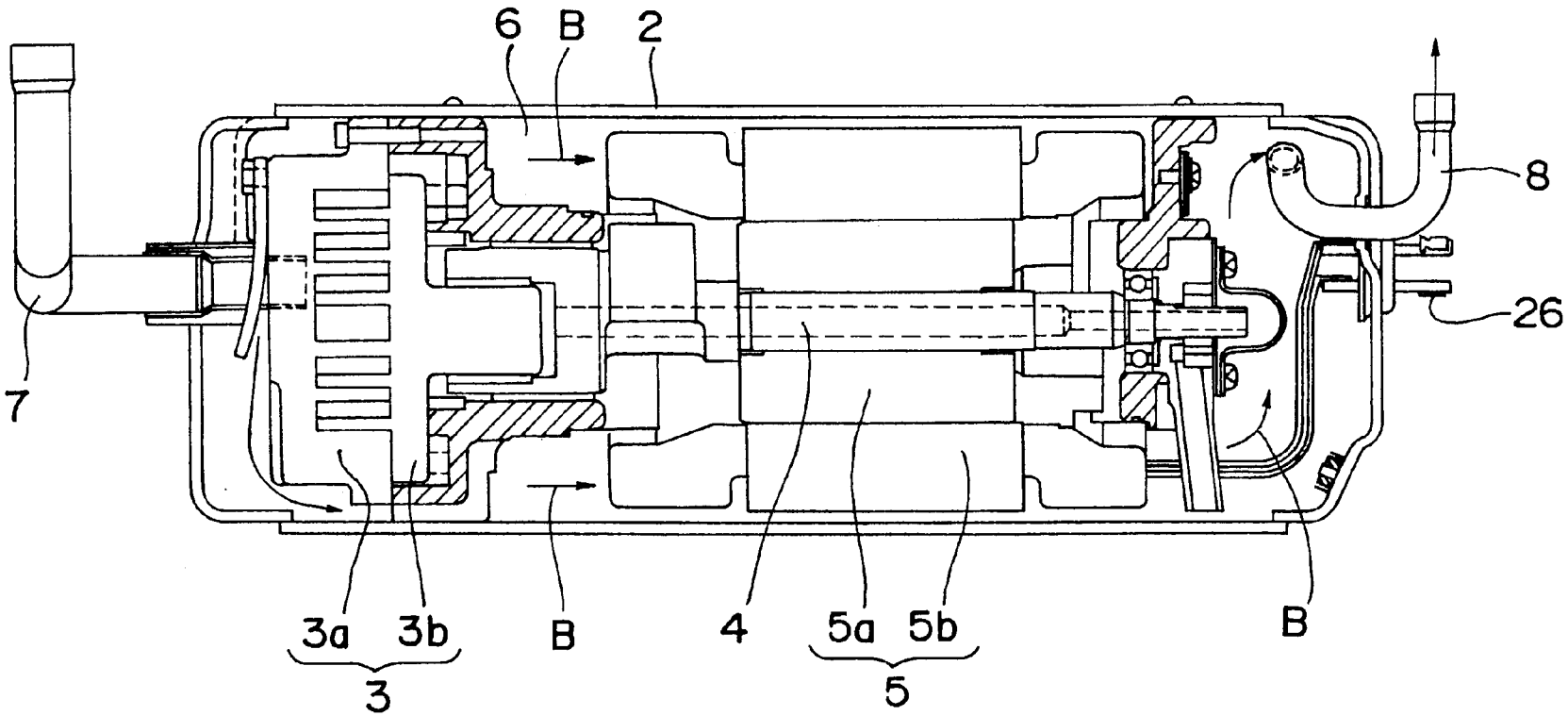
FIG. 4 is a cross sectional view showing a high-pressure dome type compressor according to another embodiment of the invention.

FIG. 4 is a cross sectional view showing a high-pressure dome type compressor according to another embodiment. Portions having the same functions as those of the portions of the high-pressure dome type compressor shown in FIG. 2 are designated by the same reference numerals. This high-pressure dome type compressor 1 is a long-sideways type scroll compressor, in which a major axis is disposed in a horizontal direction and is used as a compressor of a refrigerant unit using R32 as a refrigerant. This high-pressure dome type compressor 1 houses a scroll unit 3, a crank shaft 4 for driving this scroll unit 3 and a motor 5 for rotating the crank shaft 4 in a casing 2. The motor 5 is disposed in a high pressure area 6 filled with a discharged gas compressed in the scroll unit 3.

Furthermore, the high-pressure dome type compressor 1 comprises the same inverter (not shown) as shown in FIG. 1. This inverter is composed of an inverter unit and control unit. The control unit is connected to a temperature sensor (not shown) provided to a discharge pipe 8 and controls output current from the inverter unit. On the other hand, the inverter unit changes current from an ac power supply (not shown) based on a command from the control unit and supplies the current to the motor 5.

A stator 5*a* of the motor 5 is provided with a rare earth/iron/boron permanent magnet (not shown) and the intrinsic coercive force of the permanent magnet is 1.7 $MA.m^{-1}$ or greater. This rare earth/iron/boron permanent magnet is coated with aluminum so as not to become rusty in a relatively humid high pressure area 6 which is filled with a discharged gas and has a high temperature and not to be attacked by R32. The rated output of the motor 5 is 1.9 kW or higher.

The R32 as a refrigerant guided from an evaporator via a suction pipe 7 provided on the left side of the casing 2 is guided to and compressed in the scroll unit 3 and then discharged to the high pressure area 6, in which the motor 5 is disposed. This discharged gas passes between the motor 5 and casing 2 and between the rotor 5*a* and stator 5*b* of the motor 5, as shown by arrow B, guided to the right side in the casing 2 and discharged to a condenser via a discharge pipe 8. At this time, since the motor 5 is cooled by the discharged gas, the rare earth/iron/boron permanent magnet provided to this motor 5 is hardly demagnetized.

Furthermore, the inverter (not shown) provided to this high-pressure dome type compressor 1 receives a signal from the temperature sensor, estimates a temperature of the motor 5 and controls current to be supplied to the motor 5 such that the temperature of the motor 5 does not become equal to a predetermined temperature or higher. Therefore, in this high-pressure dome type compressor 1, the rare earth/iron/boron permanent magnet provided to the motor 5 is hardly demagnetized and thereby performance of the motor 5 becomes stable even though R32, which obtains a high temperature as a discharged gas, is used as a refrigerant.

Furthermore, the inverter receives output from a current sensor (not shown) provided in the inverter unit and calculates strength of an opposing magnetic field to be generated in the stator of the motor 5 based on this output value. Thus, the inverter controls current to be supplied to the motor 5 such that this strength of the opposing magnetic field does not become equal to a predetermined value or greater. Therefore, although this motor has a relatively high rated output and the opposing magnetic field generated in the stator of the motor is relatively strong, the rare earth/iron/boron permanent magnet provided to this motor 5 is hardly demagnetized and performance of the motor 5 becomes stable. As a result, the high-pressure dome type compressor 1 provided with this motor 5 has a small size and high output as well as stable performance.

Since performance of the high-pressure dome type compressor 1 is stable even when the R32 refrigerant is compressed, a refrigerant unit using the high-pressure dome type compressor 1 as a compressor can obtain stable freezing performance.

In the high-pressure dome type compressor 1 of the above embodiment, the temperature sensor 15 provided to the discharge pipe 8 detects the temperature of the discharged gas and estimates the temperature of the motor 5 from this temperature of the discharged gas, but the temperature sensor may be disposed in the casing 2 to directly detect the temperature of the motor 5.

The motor 5 provided to the high-pressure dome type compressor 1 of the above embodiment has the rated output of 1.9 kW, but the motor may have a rated output of 1.9 kW or higher.

The rare earth/iron/boron permanent magnet of the motor 5 provided to the high-pressure dome type compressor 1 has the intrinsic coercive force of 1.7 $MA.m^{-1}$ or greater, but the rare earth/iron/boron permanent magnet having an intrinsic coercive force of 1.7 $MA.m^{-1}$ or greater may be used.

The high-pressure dome type compressor 1 of the above embodiment is a scroll type compressor having the scroll unit 3 as a compression element, but other types such as a swing type compressor provided with a swing unit as a compression element or the like may be used.

The high-pressure dome type compressor 1 of the above embodiment uses an inverter 10, but other control means such as a voltage drooping control device, over current relay or the like may be used.

What is claimed is:

1. A high-pressure compressor comprising;

a compression element (3); and a motor (5) for driving the compression element (3) in a casing (2), the motor (5) being disposed in a high pressure area (6) filled with a gas discharged from the compression element (3) in the casing (2);

wherein the motor (5) has a rated output of 1.9 kW or higher; and a rotor (5*a*) of the motor (5) includes a rare earth/iron/boron permanent magnet (25) having an intrinsic coercive force of 1.7 $MA.m^{-1}$ or greater.

2. The high-pressure compressor according to claim 1, further comprising:

a discharge pipe (8) for discharging the discharge gas in the casing (2);

a temperature sensor (15) located on the discharge pipe (8) for detecting a temperature of the discharge gas; and first control means for, upon receipt of a signal from the temperature sensor (15), controlling a current to be supplied to the motor (5) such that the temperature of the motor (5) becomes equal to a predetermined temperature or lower.

3. The high-pressure dome type compressor according to claim 1, further comprising:

current detecting means for detecting a current flowing in the motor (5);

second control means for receiving a signal from the current detecting means and controlling a current to be supplied to the motor (5) such that an opposing magnetic field generated in the motor (5) becomes equal to a predetermined strength or less.

4. The high-pressure compressor according to claim 1, wherein the discharge pipe (8) is disposed on a side of the motor (5) different from a side on which the compression element (3) is disposed.

5. The high-pressure dome type compressor according to claim 1, wherein a discharge pipe (8) is communicated with the high pressure area (6) between the compression element (3) and the motor (5), while the gas discharged from the compression element (3) passes through a path (21) in a crank shaft (4) and is discharged to the high pressure area (6) on a side of the motor (5) opposite from the compression element (3).

6. The high-pressure dome type compressor according to claim 1, wherein the permanent magnet (25) for the rotor (5*a*) of the motor (5) is coated with aluminium.

7. A refrigerant unit comprising a high-pressure compressor according to claim 1, successively connected to a switching valve (31), a first heat exchanger (32), an expansion mechanism (33), and a second heat exchanger (34), and using R32 as a refrigerant.

* * * * *